United States Patent [19]

Ter Stege

[11] Patent Number: 4,850,517

[45] Date of Patent: Jul. 25, 1989

[54] PRESSURIZED SPRAY DISPENSER HAVING VALVED MIXING CHAMBER

[75] Inventor: Thieme Ter Stege, Grootebroek, Netherlands

[73] Assignee: Airspray International B.V., Beverwijk, Netherlands

[21] Appl. No.: 59,876

[22] PCT Filed: Sep. 26, 1986

[86] PCT No.: PCT/NL86/00031

§ 371 Date: Jun. 25, 1987

§ 102(e) Date: Jun. 25, 1987

[87] PCT Pub. No.: WO87/02014

PCT Pub. Date: Apr. 9, 1987

[30] Foreign Application Priority Data

Sep. 27, 1985 [NL] Netherlands ..... 8502651

[51] Int. Cl.[4] ..... B65D 83/14

[52] U.S. Cl. ..... 222/402.18; 141/20; 222/402.16; 222/402.24; 222/402.25; 239/337

[58] Field of Search ..... 222/400.8, 401, 402.1, 222/402.16, 402.18, 402.24, 402.25, 136, 145; 239/337, 368, 369, 372; 141/3, 20; 137/206

[56] References Cited

U.S. PATENT DOCUMENTS

| | | | |
|---|---|---|---|
| 2,518,259 | 8/1950 | Stevenson | 222/402.25 |
| 2,746,796 | 5/1956 | St. Germain | 222/402.16 |
| 3,372,845 | 3/1968 | Frangos | 222/402.18 |
| 3,544,258 | 12/1970 | Presant et al. | 222/402.18 X |
| 3,644,210 | 2/1972 | Crotty et al. | 252/548 |
| 3,704,814 | 12/1972 | Ruscitti | 222/145 |
| 3,786,963 | 1/1974 | Metzler, III | 222/136 |
| 3,851,799 | 12/1974 | Paoletti | 222/402.16 X |
| 3,955,720 | 5/1976 | Malone | 222/401 X |
| 4,247,025 | 1/1981 | Gailitis | 222/402.18 |
| 4,396,152 | 8/1983 | Abplanalp | 239/337 |
| 4,431,119 | 2/1984 | Stoody | 222/145 X |

FOREIGN PATENT DOCUMENTS

| | | | |
|---|---|---|---|
| 1909163 | 9/1970 | Fed. Rep. of Germany | 222/402.18 |
| 6810581 | 1/1970 | Netherlands . | |
| 2024335 | 1/1980 | United Kingdom . | |
| 1597147 | 9/1981 | United Kingdom . | |

*Primary Examiner*—Kevin P. Shaver

*Attorney, Agent, or Firm*—Beehler, Pavitt, Siegemund, Jagger, Martella & Dawes

[57] ABSTRACT

A spray dispenser for a liquid to be sprayed has a container provided with an inlet valve adapted for connection to a source of pressurized driving gas for pressurizing a head space above the liquid in the container. A spray head including a spray nozzle is mounted to the container and connects through a dispensing valve to a dip tube extending to the vicinity of the container bottom, such that opening of the dispensing valve causes pressurized discharge of the liquid through the spray nozzle. A mixing chamber is provided between the dip tube and the dispensing valve, which mixing chamber communicates with the head space by means of one or more spring loaded valves which admit propellant gas from the head space into the mixing chamber so long as the head space pressure exceeds a minimum preset level sufficient to ensure adequate dispersion or misting of the spray discharge thereby warning the user of the need to replenish the propellant by a clear transition between a satisfactory discharge spray and an inadequate coalesced liquid discharge.

2 Claims, 1 Drawing Sheet

PRESSURIZED SPRAY DISPENSER HAVING VALVED MIXING CHAMBER

Currently known spray cans for spraying a liquid comprise a container for said liquid with a pressurized head space situated above the liquid, and a spray head closing said container and having a spray nozzle which is connected, by means of a dispensing valve, with a tube extending downwards to the vicinity of the bottom.

In the liquid a driving substance or propellant which is, at the normal pressure, a vapor, e.g., freon, is dissolved, and its vapor pressurizes the head space so that, upon opening the dispensing valve, the liquid is driven through the spray nozzle. The amount of driving substance should be sufficient for allowing the complete liquid contents to be sprayed in this manner. At each spraying, however, driving substance will be sprayed together with the liquid.

Because of the environmental objections existing against freon, containers of the above-mentioned kind have already been designed in which the pressure space can be filled by means of a pump with compressed air. Apart from the fact that, in this manner, the use of freon can be avoided, an additional advantage is obtained in that the container, after being emptied, can be filled again with the liquid to be sprayed.

In the case of a driving substance dissolved in the liquid and being sprayed together with the liquid, said liquid is divided into very small droplets, and the driving substance will vaporize immediately after spraying. These fine droplets allow a good distribution of a small amount of the liquid over the surface to be sprayed, without the liquid combining into larger drops whereby the surface to be sprayed would become too wet. When using a driving gas which is not dissolved in liquid form in said liquid, such as air, a so-called "dry spraying" is not truly obtainable especially where the liquid to be sprayed has a high viscosity and/or coherence. This is particularly difficult in the case of liquids such as hair varnish, sun-burn oil and other liquids to be sprayed on the body, and also in the case of lubricating oil, cleaning liquid for electrical contacts and the like, excessive spraying of which is objectionable or even harmful.

All this is a consequence of the fact that the liquid discharged from the nozzle remains more or less coherent or coalesces into larger drops, whereas, when using a vaporising driving substance, the coherence is broken by vaporisation of the driving substance, so that the small droplets remain in existence.

The difficulty mentioned above impedes wider use of spray means operating without a dissolved vaporising driving substance, and in particular using air as the propellant.

The invention provides a spray means of this kind which overcomes this objection.

The spray means according to the invention, which is intended for being arranged on a container for a liquid to be sprayed, in which container a head space for a pressurized driving gas such as compressed air is present above the liquid, the spray means comprising a spray head closing said container and having a spray nozzle which, by means of a dispensing valve, it connected with a dip tube extending downwards to the vicinity of the bottom of the container, so that upon opening the dispensing valve, the liquid is driven by the driving gas towards the spray nozzle in order to be sprayed therefrom, and is characterised in that the dip tube communicates with a mixing chamber which in turn communicates through the dispensing valve with the spray nozzle, and also communicates with the head space, in such a manner that upon opening the dispensing valve, a mixture of driving gas and liquid is driven out through said nozzle.

By turbulence in said mixing chamber the liquid is mixed with the driving gas, e.g. compressed air, the effect being that the desired spraying in the form of small droplets will occur.

The mixing chamber can be a venturi passage connected with the pressure chamber or head space, and the upper end of the dip tube communicating with the narrow portion of said venturi passage.

Preferably the mixing chamber comprises a more or less conical wall, the wider extremity thereof joining the upper wall of the pressure chamber, and said dip tube opening into the smaller extremity thereof, said chamber surrounding the discharge passage towards the spray nozzle, in which wall one or more apertures are provided directly communicating with the pressure space, all this in such a manner that said mixing chamber operates as a whirling space enhancing the intermixing.

The connection between the mixing chamber and the pressure space can have such a cross-section relative to that of the discharge passage and of the dip tube so that the correct mixing ratio between gas and liquid will be obtained.

In the case of a spray means for a container having a pressure chamber which can be filled by means of a pump or the like with compressed air, the connection between the mixing chamber and the pressure space can be provided with a spring-loaded valve which is only opened as soon as the pressure in the pressure chamber exceeds a given value at which a good intermixing will take place in the mixing chamber.

In one particular embodiment of this invention in which the dispensing valve forms a unit with the spray nozzle, and in which the valve is opened by pressing the nozzle inward against the force of a nozzle valve spring, which nozzle communicates by means of a hollow stem with the interior of said container, said stem being movable through a seal in said mixing chamber, said hollow stem having at least on lateral aperture which is normally separated from the interior of the mixing chamber by said seal, and upon pressing of the stem inwards to the container can be shifted beyond said seal into said mixing chamber.

In particular, said seal may be formed by a sealing disc surrounding said stem and normally bearing against the upper wall of the mixing chamber, said stem being provided on both sides of said disc with a wider shoulder between which shoulders the lateral aperture communication opening of the stem bore is situated, the lower shoulder normally pressing said disc against the upper wall by the action of the nozzle valve spring.

Said sealing disc can extend beyond a lateral wall defining said mixing chamber, said disc being pressed upon pressing inwards on said stem, against said wall with the force required for the limiting valve action.

Moreover the upper wall of said container can be provided with one or more air entry apertures which are closed by said sealing disc under the nozzle valve spring force and the internal head space pressure.

Furthermore said stem can be provided with a coaxial extension piece which, together with the wall of the mixing chamber, defines an annular passage in which the connection with the pressure chamber opens.

An auxiliary element can be connected with the supply aperture for compressed air of said container, which auxiliary element is characterized by a mixing chamber with a coupling piece for making a connection with a water supply, and is adapted for containing therein a substance which is soluble in water for forming a liquid solution to be sprayed, such that water with the dissolved substance can be introduced through the filling valve of said container into said container by the pressure of the water supply. At the same time the air present in said container will then be compressed.

The invention will now be elucidated in more detail by reference to the accompanying drawings showing in:

FIG. 1 a schematic cross-section of a spray can showing the principle of the invention;

FIG. 2 a simplified cross-section of one embodiment of a spray can according to the invention in accordance with FIG. 1;

FIG. 3A a cross-section of a practical embodiment of a spray can in accordance with FIG. 2;

FIG. 3B is a partial cross-section of the spray can of FIG. 3A of the spray dispensing condition; and FIG. 4 is a cross-section of an optional auxiliary element for supplying a liquid solution under pressure to the spray can according to the invention.

DETAILED DESCRIPTION OF THE PREFERRED EMBODIMENT

Figure 1:
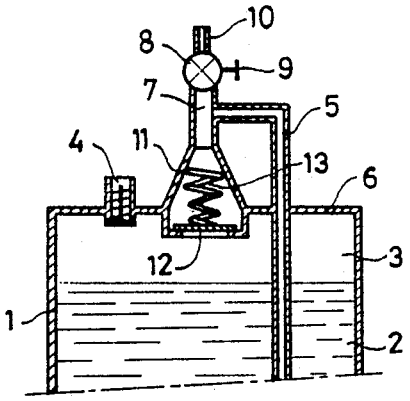

FIG. 1 shows a spray can including a container 1, in which is contained the liquid to be sprayed. Above the liquid 2 an air space or head space 3 is present, which, by means of a filling valve 4, can be pressurised by means of an air pump or the like. A dip tube 5 extends through the upper wall 6 of said container into the interior and to the vicinity of the bottom of said container. The upper end of said dip tube 5 opens into a discharge passage 7 which is closed by means of a valve 8 connected to an actuating part 9, terminating in a spray nozzle 10. The discharge passage 7 communicates, at its lower end, with an enlarged chamber 11 which communicates, by means of a valve 12 biased by a valve spring 13, with the head space 3.

Upon opening the valve 8 by means of the part 9, the liquid 2 is driven upwards through said dip tube 5 by the pressure in the head space 3, and, if the pressure in the space 3 is sufficiently high, the valve 12 will be opened by said pressure against spring 13. The enlargement 11 forms, together with the passage 7, a venturi passage in which an intermixing of air and liquid takes place by turbulences, so that, through the nozzle 10, a fine mist of liquid droplets is sprayed. The spring 13 is adjusted in such a manner that, as soon as the pressure in the space 3 falls to a level insufficient for effecting such an intermixing, no mist will be dispensed any more. The pressure in the space 3 should then be restored by means of the external air pump.

Filling the container 1 with the liquid 2 can be done in any suitable manner, for instance by removing the cover 6, and it is also possible to fill by means of the filling aperture 4.

Figure 2:
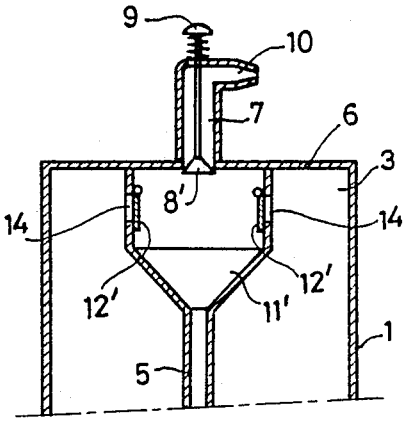

The practical embodiment of such a spray can be difficult. FIG. 2 shows, in principle, an embodiment of a spray can according to the invention, in which such difficulties can be avoided. Corresponding parts are indicated therein with the same reference numerals as in FIG. 1.

In FIG. 2 a mixing chamber 11' is provided within the container 1, and the tip tube 5 opens into that chamber at its lower end. At the upper end a dispensing valve 8' being directly mounted on the wall 6 is provided with the passage 7 and with the spray nozzle 10 which can be opened by means of a spring-loaded actuating part 9. The mixing chamber 11' communicates, by means of one or more apertures 14, with the head space 3, said apertures being normally closed by means of spring-loaded valves 12'.

Upon opening the valve 8' an air/liquid mixture formed in the mixing chamber 11' is discharged, said mixing chamber 11' being shaped in such a manner that a good intermixing is obtained by means of turbulences. The valves 12' are loaded by a spring force such that, as soon as the pressure in the head space 3 becomes too low, no propellant air will enter the mixing chamber 11' any more.

FIG. 3 shows a practical embodiment of the principle shown in FIG. 2. In FIG. 3 the spray nozzle 10 is now included in a body 15 which can be shifted in an opening 16 of the container cover wall 6, and is normally driven upwards by means of a spring 17, a shoulder 18 limiting the upward displacement under the influence of said spring. In this body, which, at the same time, serves as the actuating part 9, a passage 7 is provided which, at one end, terminates in a spray nozzle 10, and, at the other end, joins a transverse bore 19 opening just above the shoulder 18 in the lateral wall of a stem constriction 20. This constriction 20 is, at its lower end, delimited by a lower shoulder 21.

Figure 3A:
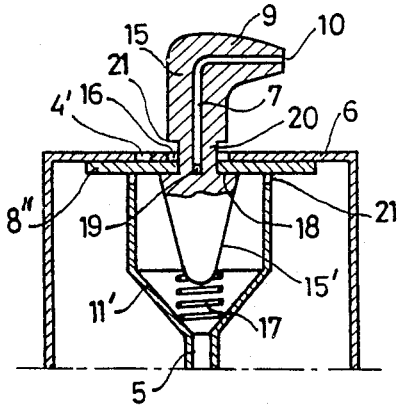

Between the shoulders 18 and 21 lies a valve disc 8'' which, in the condition shown in FIG. 3A, is pressed by the lower shoulder 21 against the upper wall 6, and the connection between the passage 7' through the transverse bore 19 and the interior of the container 1 is closed by the disc. Said disc 8'' extends through an opening 21 int he wall of the mixing chamber 11', which opening is sufficiently large for providing an air passage, between its edge and the disc 8''. The mixing chamber 11' is connected with the wall 1 of the container by means of supports not shown.

Furthermore, an air supply aperture 4' is formed in the upper container wall 6 which is normally kept closed by the disc 8'' as a consequence of the internal head space pressure in the container 1. The aperture 4' can be connected to an air pump or another source of pressure in order to pressurize the head space air chamber 3 of the container 1. At a sufficient overpressure of air supplied to aperture 4' the disc 8'' will then be pressed away from the wall 6, so that the supplied air can flow into the container 1.

Figure 3B:
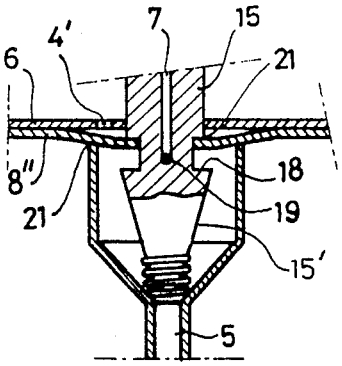

FIG. 3B shows the condition of the spray can if the body 15 is pressed downwards. The body 15 and stem 20 is shifted through the disc 8'' until the upper shoulder 21 contacts said disc. The transverse bore 19 will then communicate with the air chamber 3, so that an air/liquid mixture can flow from the mixing chamber 11' towards the passage 7'. In the depressed condition of FIG. 3B the valve disc 8'' is pressed against the edge of the opening 21, and will then operate in the manner of the valves 12' of FIG. 2. At a sufficient pressure in the head space 3, the propellant air can flow from said head space into the interior of the mixing chamber 11' by pressing the disc 8'' a little upwards and away from the edge of the opening 21 in the mixing chamber wall.

The lower portion 15' of the body 15 is shaped in such a manner that, together with the wall of the chamber 11, a whirling chamber is defined which is adapted to provide an optimal mixing effect.

Figure 4:
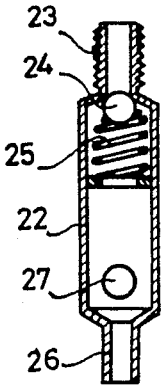

Finally FIG. 4 shows an auxiliary element for a spray can according to this invention, which is intended to be connected to the connections 4 or 4' in FIGS. 1-3. This auxiliary element comprises a casing 22 with, at one extremity, a hose coupling or screw nipple 23, adapted to be connected to a water tap. The passage through the casing 22 is kept closed by means of a ball valve 24 or the like with a compression spring 25, the strength of said spring being adapted to the water pressure. At the other end this auxiliary element comprises a connector 26 to be connected with the spray can connection 4 or 4'.

This auxiliary element is intended for spraying a liquid consisting of water and a component dissolved therein, said component being available in the form of a tablet 27 or the like which can be inserted in the interior of the casing 22. While connected to the water supply, water at the supply pressure can be introduced into the container 1, the component being present in the tablet 27 or the like then dissolving in the water, and, at the same time, the air present in the container 1 being compressed to a pressure depending on the water supply pressure.

It will be clear that within the scope of the invention many modifications can be made. It will, sometimes, already be sufficient to provide one or more holes at the lower end of the dip tube 5, said dip tube itself then acting as the mixing chamber.

I claim:

1. A spray dispenser comprising a container for a liquid to be sprayed, inlet means in said container for pressurizing a head space above the liquid with a driving gas, a spray head including a spray nozzle through a dispensing valve to a dip tube extending downwards to the vicinity of the bottom of the container such that upon opening of said dispensing valve the liquid is driven through the dip tube by the driving gas towards the spray nozzle and sprayed therefrom, a mixing chamber between said dip tube and said dispensing valve, normally open passage means communicating said head-space with said mixing chamber, a sealing disc displaceable upon actuation of said dispensing valve for initially closing said passage means, said disc being deformable in said displaced condition by a sufficient pressure differential between said head space and mixing chamber for opening said passage means to admit head space driving gas into said mixing chamber such that a mixture of driving gas and liquid is delivered to said spray nozzle only while the pressure in the head space exceeds a minimum predetermined level at which adequate mixing in the mixing chamber still takes place to disperse the sprayed liquid, means for biasing said dispensing valve to a closed position, and said inlet means being normally closed by said sealing disc.

2. A spray dispenser comprising a container for a liquid to be sprayed, said container having inlet means adapted to be connected to a source of a pressurized driving gas for pressurizing a head space above the liquid, a spray head including a spray nozzle connected through a dispensing valve to a dip tube extending downwards to the vicinity of the bottom of the container such that upon opening of said dispensing valve the liquid is driven through the dip tube by the driving gas towards the spray nozzle and sprayed therefrom, a mixing chamber between said dip tube and said dispensing valve, passage means in said mixing chamber communicating said head-space with said mixing chamber, valve means associated with said passage means for admitting driving gas from said head space into the mixing chamber when the dispensing valve is opened such that a mixture of driving gas and liquid is delivered to said spray nozzle, means for biasing said valve means for closing said passage means against driving gas pressure in said head space, said valve means remaining open against said bias only while the pressure in the head space exceeds a minimum predetermined level at which adequate mixing in the mixing chamber still takes place to disperse the sprayed liquid when said dispensing valve is opened.

* * * * *